US005752992A

United States Patent [19]

Hendriksen

[11] Patent Number: 5,752,992

[45] Date of Patent: May 19, 1998

[54] USE OF TERTIARY-HEXYL METHYL ETHER AS A MOTOR GASOLINE ADDITIVE

[75] Inventor: Dan Eldon Hendriksen, Kingwood, Tex.

[73] Assignee: Exxon Chemical Patents Inc. (ECPI), Houston, Tex.

[21] Appl. No.: 778,480

[22] Filed: Jan. 3, 1997

Related U.S. Application Data

[63] Continuation of Ser. No. 451,638, May 26, 1995, abandoned, which is a continuation-in-part of Ser. No. 167,390, Dec. 15, 1993, abandoned.

[51] Int. Cl.[6] ..... C10L 1/18

[52] U.S. Cl. ..... 44/449

[58] Field of Search ..... 44/449

[56] References Cited

U.S. PATENT DOCUMENTS 4,193,770 3/1980 Chase et al. ..... 44/449

FOREIGN PATENT DOCUMENTS 0 036 260 9/1981 European Pat. Off. .

2854250 6/1979 Germany .

OTHER PUBLICATIONS

Hawley's 11th Ed. Condensed Dictionary, New York, Van Nostrand Reinhold, 1987, p. 849.

Unzelman, Oil & Gas Journal, vol. 44, Apr. 15, 1991.

"Physical Constants of Hydrocarbon and Non–Hydrocarbon Compounds" ASTM data series publication DS 4B, 1991, pp. 1–100, 1–101, and 1–135.

Pescarollo et al "Etherify light gasolines." Hydrocarbon Processing, Feb. 1993, pp. 55–60.

MICROLOG–88–03391 from Energy Res. Abstr., 13(22), Abstr. No. 50631, 1988.

*Primary Examiner*—Prince Willis, Jr.
*Assistant Examiner*—Cephia D. Toomer
*Attorney, Agent, or Firm*—Linda K. Russell

[57] ABSTRACT

A tertiary-hexyl methyl ether composition comprising 2-Methoxy-2,3-dimethyl butane (MDMB) in an amount of at least 10% by weight based on the total tertiary-hexyl methyl ethers is useful as an octane booster for motor gasoline or motor gasoline feedstock.

33 Claims, No Drawings

USE OF TERTIARY-HEXYL METHYL ETHER AS A MOTOR GASOLINE ADDITIVE

This application is a continuation of Ser. No. 08/451,638, filed May 26, 1995, now abandoned which is a continuation in part of Ser. No. 08/167,390, filed Dec. 15, 1993, now abandoned.

FIELD OF THE INVENTION

This invention relates to the use of one isomer of tertiary-hexyl methyl ether, which is 2-methoxy-2,3-dimethylbutane, as an octane booster in motor gasoline.

BACKGROUND OF THE INVENTION

Generally, any component that has a research octane number over 105 and a motor octane number over 95 is considered to be an octane booster for use in motor gasoline. It is well known in the art that ethers made from $C_4$ and $C_5$ olefins are excellent octane boosters. Methyl tertiary-butyl ether (MTBE) made from isobutene, a $C_4$ olefin, has a research octane number (RON) of 118 and a motor octane number (MON) of 100; and tertiary-amyl methyl ether (TAME) produced from $C_5$ olefins has a RON of 111 and a MON of 98 according to Unzelman, Oil & Gas Journal, Volume 44, Apr. 15, 1991.

It is also well known that these ethers have a higher octane booster number than their counterpart olefins. "Physical Constants of Hydrocarbon and Non-Hydrocarbon Compounds" ASTM data series publication DS 4B, 1991 states that the octane numbers for one of the parent olefins of TAME, 2-methyl-2-butene, is 97 for the RON and 82 for the MON. Etherification of this $C_5$ olefin increases the octane numbers to 111 for the RON and 98 for the MON. While the art teaches that ethers produced from $C_4$ and $C_5$ olefins are excellent octane boosters, it teaches away from the use of ethers produced from $C_6$ and heavier olefins.

For example, in Pescarollo et al.'s article, "Etherify light gasolines", Hydrocarbon Processing, February 1993, pp 53–60, he states that "... ethers derived from $C_6$ and heavier olefins do not significantly enhance octane over the parent olefins".

Also, U.S. Pat. No. 4,193,770, and its equivalent, DE-A-2,854,250 (1979) teach that the octane numbers of the $C_6$ ethers are no higher than those of the parent olefins mixed with the same amount of methanol. The blending octane numbers for tertiary-hexyl methyl ether which is produced from a $C_6$ olefin are reported as being 100 for the RON and 90 for the MON, but no mention is made of any specific isomers, including 2-methoxy-2,3-dimethylbutane (MDMB). Hence, there is no recognition or teaching that MDMB is effective as an octane booster. The reported numbers serve to teach away from investigating the performance of ether produced from $C_6$ or $C_7$ olefins.

This reference teaches the importance of etherifying $C_4$ and $C_5$ olefins separately from each other because of the different reaction kinetics. Also stressed is the importance of keeping each of these fractions separate from the $C_6$ olefin fraction, which forms tertiary hexyl methyl ether, because there is no improvement in octane rating as compared to the ethers from the $C_4$ and $C_5$ olefins. The reference goes as far as saying that any reported increases in octane rating for ethers from $C_6$ and $C_7$ olefins, are "illusory". See column 3, lines 5 to 13 and 26 to 37.

This reference sets up a major prejudice against using $C_6$ ethers as motor gasoline octane boosters. And there is absolutely no mention of MDMB.

MICROLOG-88-03391 from Energy Res. Abstr., 13(22), Abstr. No. 5031, 1988, also teaches against the use of ethers produced from $C_6$ olefins in that "predictions for $C_6$ ethers were not carried out because there was virtually no improvement in octane number when compared with its precursors".

EP-A-0 036 260, discloses the use of ethers as components in a motor gasoline blend produced from a mixture of $C_4$ through $C_7$ olefins from a refinery catalytic cracker unit, with 7% being $C_6$ olefins, but reinforces the belief that the octane booster effect is due to the ethers produced from $C_4$ and $C_5$ olefins rather than those ethers produced from $C_6$ or $C_7$ olefins.

It would be desirable if ethers produced from $C_6$ olefins could be used as motor octane boosters. Current market predictions indicate that there will be a glut of propylene, which could be used to make $C_6$ olefins, in the market place within the next ten years. Currently, propylene is sent to the motor gasoline pool from refinery catalytic crackers, but the propylene does not boost the octane. It would be very profitable if one could determine a way to convert propylene into an octane booster.

SUMMARY OF THE INVENTION

This invention relates to using an octane boosting amount of a tertiary hexyl methyl ether component comprising 2-methoxy-2,3-dimethyl butane (MDMB) which enables providing a blend comprising:

(a) motor gasoline or motor gasoline feedstock; and (b) an octane boosting amount of a tertiary hexyl methyl ether component comprising 2-methoxy-2,3-dimethyl butane (MDMB) in an amount of at least 10% by weight based on the total weight of tertiary hexyl methyl ether, wherein composition (b) has a Research Octane Number (RON) and/or a Motor Octane Number (MON) greater than those of composition (a).

A second embodiment includes providing a method of increasing the octane number in motor gasoline comprising blending MDMB with the motor gasoline or with a motor gasoline feedstock to boost the octane number of the motor gasoline or motor gasoline feedstock which contains a sufficient amount of composition (b) to boost the octane number of component (a) by at least 1 unit.

The tertiary hexyl methyl ether component comprising MDMB may be prepared by dimerizing propylene, and additional embodiments of the present invention include a blend wherein composition (b) is made by a process comprising:

(i) dimerizing propylene to form dimethylbutenes; and (ii) etherifying the dimethylbutenes with methanol, to form the desired composition and/or a blend.

Additionally, yet another embodiment includes the further treatment wherein step (ii) comprises partial etherification and is followed by (iii) hydrogenation of unetherified dimethylbutenes to form a tertiary hexyl methyl ether composition comprising MDMB and dimethyl butanes.

DETAILED DESCRIPTION OF THE INVENTION

Not all of the isomers of tertiary-hexyl methyl ether produced from $C_6$ olefins are suitable for use as octane boosters. The four isomers of tertiary-hexyl methyl ether ($C_6H_{13}$—$OCH_3$) are as follows:

1) 2-Methoxy-2,3-dimethylbutane (MDMB)

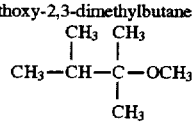

2) 2-Methoxy-2-methylpentane (2MMP)

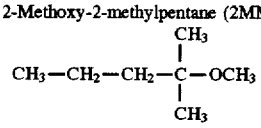

3) 3-Methoxy-3-methylpentane (3MMP)

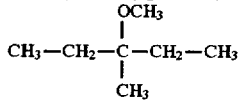

4) 1-Methoxy-1-methylcyclopentane (MMCP)

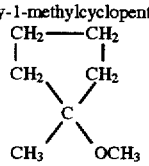

1-Methoxy-1-methylcyclopentane (MMCP) is considered an isomer of tertiary-hexyl-methyl ether even though it has two fewer hydrogen atoms.

One isomer of tertiary-hexyl methyl ether has been found to be a very useful high octane booster for use in motor gasoline. That particular isomer is 2-methoxy-2,3-dimethylbutane (MDMB).

MDMB may be prepared from propylene and methanol by first dimerizing the propylene to dimethylbutenes (2,3-dimethyl-(1 and/or 2)-butene), and then by etherifying the dimethylbutenes with methanol, as shown in the following reaction equations. Both 2,3-dimethyl-1-butene and 2,3-dimethyl-2-butene react with methanol to form the desired product ether.

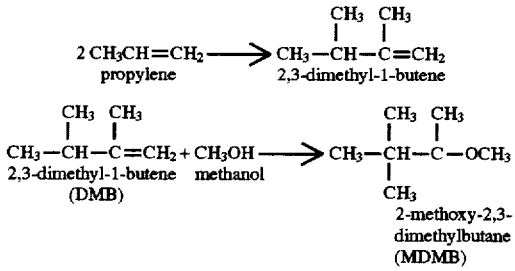

Olefin dimerization and codimerization processes are known in the art. The propylene may be dimerized to dimethylbutenes (DMB) using a tungsten catalyst, such as that disclosed in U.S. Pat. No. 5,059,739. The dimethylbutenes (DMB) may also be produced using nickel with specific organo-phosphine ligands.

In the event, the tungsten catalyst is used, the ratio of olefin to tungsten should be such that a catalytic amount of the tungsten complex is used. The reaction pressure is normally the pressure generated by the olefin at the reaction temperature, although the pressure may be increased with an inert gas. The reaction temperature may range, for example, from, about 40° to 100° C., with 50° to 80° C. being preferred. The reaction or resistance time may be, for example, from 5 minutes to about 3 hours, with 0.5 to 2.0 hours being preferred. The preferred embodiment uses a catalyst which is prepared by taking a tungsten salt and an aniline to form a complex of the tungsten salt and aniline. Substantially all of the hydrogen chloride produced in this reaction is removed from the solution during the course of the reaction. After formation of the tungsten and aniline complex, an alkyl aluminum halide is added to the solution to form the active catalyst system of the invention. The preferred feedstock is refinery grade propylene, after sufficient removal of water and other catalyst poisons.

The etherification of the dimethylbutenes with methanol to prepare MDMB may take place in a manner similar to the preparation of methyl tertiary-butyl ether (MTBE) from isobutylene or the preparation of tertiary-amyl methyl ether (TAME) from isoamylenes. The reaction takes place over the acid form of an ion exchange resin.

The present invention involves the feeding of a mixture containing DMB and methanol into the feed zone of a reactor (i.e., a fixed-bed guard reactor), and contacting the resultant mixture of DMB and methanol with a fixed bed acidic cation exchange resin (e.g., Amberlyst® 15) in the reaction zone, thereby catalytically reacting the DMB with the methanol under conditions which favor forming the resultant 2-methoxy-2,3-dimethylbutane (MDMB).

Where the etherification step of the present invention is practiced in a catalytic distillation process, the catalytic material may be in any form which permits its incorporation into a distillation tower, such as a fixed bed, but may also be in a form which serves as a distillation packing, for example, rings, saddles, balls, irregular pieces, sheets, tubes, spirals, packed in bags, plated on grills or screens, and reticulated polymer foams.

Catalysts which have been found to be suitable for use in the etherification step of the present invention are resin catalysts such as cation exchange resin catalysts, acidic resin catalysts, macroreticular sulfonic acid cation exchange resin catalysts, and solid acid catalysts. Still others have used a zeolite as an etherification catalyst. Preferred catalysts for purposes of the present invention, however, are acid catalysts, such as acidic resin catalysts. A more preferred catalyst for purposes of the present invention is a macroreticular sulfonic acid cation exchange resin such as a sulfonated copolymer of polystyrene-divinyl-benzene. Such catalysts include Amberlyst® 15 and 15C (marketed by Rohm and Haas), Lewatit SPC 118 and SPC 118 BG (marketed by Miles/Bayer), and Dowex M-31 and M-32 (marketed by the Dow Chemical Co.). A special version of this type of catalyst, i.e., Dowex DR-2040 (marketed by the Dow Chemical Co.), is used specifically for reactive distillation.

It has been found that equilibrium conversion to ether is only 50–60%, so it is expected that catalytic distillation will be advantageous in the etherification step. Catalytic distillation is commercially practiced in the production of MTBE and this process has been extensively explored with TAME. Therefore, there is every reason to expect that catalytic distillation would be advantageous when applied to the process for producing ethers from $C_6$ olefins.

When the ether is produced from a $C_6$ olefin which has been formed by dimerizing propylene, the composition of the resulting mixture of isomers may be as pure as 98 wt % MDMB, 2 wt % 2 MMP, with negligible amounts of 3 MMP and MMCP. When the $C_6$ olefin is produced in a refinery catalytic cracker, the isomer mixture is different, with more than 50% being 2 MMP and approximately 7% being MDMB.

It is well known in the art that ethers are used as motor gasoline additives to enhance the quality of the motor gasoline due to environmental regulations, both existing and pending in the USA. By using an oxygenate rather than its counter part olefin in motor gasoline, less carbon monoxide pollution is produced upon combustion of the motor gasoline. Also, the rules regulating reformulated gasoline, which is a particular type of motor gasoline, require that a lower olefin content be present in the gasoline due to the fact that olefins contribute to ozone formation more than their counter part ethers. An additional advantage of using the ether rather than the olefin in motor gasoline is that the ether has a lower Reid vapor pressure, which reduces evaporative emissions which contribute to pollution.

The addition of the MDMB to the motor gasoline or motor gasoline feedstock to boost the octane may be accomplished in several ways. One method includes the preparation of a blend comprising the mixture of two compositions, (a) and (b), wherein composition (a) consists of the motor gasoline or motor gasoline feedstock which is blended with composition (b) which comprises an octane boosting amount of a tertiary hexyl methyl ether component comprising 2-methoxy-2,3-dimethyl butane (MDMB) in an amount of at least 10% by weight based on the total weight of tertiary hexyl methyl ether, wherein the composition (b) has a Research Octane Number (RON) and/or a Motor Octane Number (MON) greater than those of composition (a).

In addition to the other tertiary hexyl methyl ethers and the MDMB, composition (b) may include other components. These additional components may be any other hydrocarbons or oxygenates typically found in motor gasoline or motor gasoline feedstocks, including, but not limited to, aromatics, olefins, saturates, and ethers.

These additional components may or may not be considered useful as octane boosters. In the case where the additional components are useful as octane boosters, composition (b) may include either MTBE or TAME, or mixtures thereof.

Composition (b) may have a RON greater than 95, preferably greater than 100, and/or a MON greater than 85, preferably greater than 90.

Optionally composition (b) has a blending RON greater than 100, preferably greater than 105 and/or a blending MON greater than 90, preferably greater than 95.

The tertiary hexyl methyl ether component of composition (b) may comprise greater than 10%, preferably from 20 to 100%, by weight of MDMB. Optionally, this tertiary hexyl methyl ether component of composition (b) may comprise from 50 to 100%, preferably greater than 80%, by weight of MDMB.

The tertiary hexyl methyl ether component may have a RON greater than 100 and/or a MON greater than 90. Optionally, this tertiary hexyl methyl ether component may have a blending RON greater than 100 and/or a blending MON greater than 90.

The MDMB component of composition (b) may have a RON greater than 105 and/or a MON greater than 95. Optionally, the MDMB component may have a blending RON greater than 105 and/or a blending MON greater than 95.

The resulting blend may have a RON greater than 90, preferably greater than 93, and/or a MON greater than 80, preferably greater than 83.

A sufficient amount of composition (b) may be blended with composition (a) such that the octane number of component (a) is boosted by at least 1, preferably by at least 2, and more preferably by at least 3 units. The resulting blend may comprise greater than 1%, preferably greater than 2%, and most preferably greater than 5%, by volume of MDMB.

In addition to its use as an octane booster, MDMB has the added benefit of not significantly increasing the RVP of the motor gasoline blend as is typical with other octane boosters, such as MTBE or TAME.

For example, MTBE has a blending RVP of 57.9 kPa (8.4 psi) and TAME has a blending RVP of 27.6 kPa (4.0 psi), both of which are higher than that of MDMB being 6.9 kPa (1 psi).

When the starting motor gasoline feedstock has a high RVP level, one could be limited on how much MTBE or TAME addition is possible to achieve the required octane requirements, while at the same time, not exceeding the RVP limit.

Therefore, an additional embodiment of the present invention includes the use of more than one octane booster to achieve the maximum octane boosting effect and without the corresponding undesirable increase in RVP.

For example, one could make a blend comprising the addition of MTBE and/or TAME up to the maximum RVP limit of the motor gasoline product as set by an environmental standard. Then, MDMB, either alone or in mixture with the tertiary hexyl methyl ether, could be blended into the motor gasoline to achieve an even higher octane number without incurring any increase in the RVP of the final blend of motor gasoline.

One embodiment of the invention includes a blend which contains a sufficient amount of composition (b) to boost the octane number of component (a) by at least 1, while at the same time increasing the Reid vapor pressure of component (a) by less than 13.8 kPa (2 psi), preferably by less than 6.9 kPa (1 psi), and more preferably by less than 3.4 kPa (0.5 psi).

The MDMB may be prepared using a process comprising (i) dimerizing propylene to form dimethylbutenes and (ii) etherifying the dimethyl butenes with methanol. Optionally, wherein step (ii) comprises partial etherification, the process may further comprise the additional step of (iii) hydrogenation of the unetherified dimethylbutenes to form a tertiary hexyl methyl ether composition comprising MDMB and dimethyl butanes.

Composition (b) may contain dimethylbutenes and may also contain less than 1% methanol and/or less than 5% olefins. Composition (b) may contain greater than 50%, preferably from 60% to 100%, and more preferably greater than 80%, by weight of the tertiary hexyl methyl ether.

By blending the prepared MDMB, with a motor gasoline or motor gasoline feedstock, the octane number of the blended gasoline may be increased by 1 or more units, preferably 2 or more units, and most preferably 3 or more units, over the original octane number of the motor gasoline or motor gasoline feedstock.

The foregoing invention will now be illustrated by, although not limited to, the following examples.

EXAMPLES

Example I

2-MMP Comparative Example

This comparative example illustrates that not all ethers produced from $C_6$ olefins are useful as octane boosters.

An ion exchange resin in the acid form (Amberlyst® 15, washed with methanol) was added to a 5000 mL roundbottom flask along with 1000 g of 2-methyl-1-pentene and 416 g methanol. The slurry of resin catalyst was stirred magnetically and refluxed at atmospheric pressure for 16 hours. In the refluxing process, the material boils at atmospheric pressure and condenses the vapors back into the boiling material. The resin catalyst was filtered from the product mixture, and then unconverted methanol and methyl pentenes were distilled away from the product ether (2 MMP). The unconverted materials were placed back in the reaction flask with the resin catalyst and refluxed again for another 16 hours. This procedure of reaction followed by removal of product ether was repeated three times. This was desirable in order to achieve good conversion of the starting material since the etherification reaction is equilibrium limited. The product ether was distilled again (boiling point 112° C.) to yield product purity of 99.4% by GC analysis.

The octane numbers and Reid vapor pressure results were measured using the standard test methods well known in the art. The Research Octane Number (RON) was 88.3 and the Motor Octane Number (MON) was approximately 90. The precise MON could not be measured as the fuel/air ratio was set at the highest setting available on the test engine. In the standard test procedure, the fuel/air ratio is continually increased until maximum knock is obtained. The Reid vapor pressure was 1.25 psi.

These results are consistent with the reported octane numbers for ethers of $C_6$ olefins, and support the industry view (for example, as expressed in U.S. Pat. No. 4,193,770) that such ethers are not useful as octane boosters for motor gasoline.

Example II

MDMB—the Invention

This example of the invention illustrates that one of the ethers produced from $C_6$ olefins, specifically MDMB, is useful as an octane booster.

2-Methoxy-2,3-dimethyl butane (MDMB) was prepared from 2,3-dimethyl-2-butene (2112 g) and methanol (879 g) in a similar manner as described for preparation of 2 MMP in Example I. The product had a boiling point of 115° C. and a product purity of 98.2% 2-methoxy-2,3-dimethylbutane with the balance being 2-methoxy-2-methyl pentane from 2-methylpentene impurity in the starting material. The Research Octane Number measured for this MDMB rich product was 108.1 and the Motor Octane Number was 96.8. The Reid vapor pressure was 7.3 kPa (1.06 psi).

Analysis of Examples I and II

The octane numbers from Examples I and II along with those of ethers made from $C_4$ and $C_5$ olefins are reproduced below in a table format for easy comparison.

| Parent Olefin | Ether | RON | MON |
|---|---|---|---|
| $C_4$ | MTBE | 118 | 100 |
| $C_5$ | TAME | 111 | 98 |
| $C_6$ | MDMB | 108.1 | 96.8 |
| | 2MMP | 88.3 | less than 90 |

One can see that unexpectedly, and contrary to the prejudice arising from the prior art investigation of $C_6$ olefin ether, MDMB has RON and MON values which make it surprisingly good as an octane booster for motor gasoline.

Example III

In addition to the component RON, MON, and Reid vapor pressure (RVP) numbers being determined, a corresponding set of blending values for MDMB was also ascertained. As it is well known to one of ordinary skill in the art, the "blending" RON, MON, and RVP values vary based upon the base gasoline composition. Typically, the "Blending Values" (BV) are higher for RON and MON.

Blends of approximately 14, 19, and 25% volume MDMB, as synthesized in Example II, were prepared using two different gasolines, A and B, as described below.

| | Gasoline A | Gasoline B |
|---|---|---|
| RON | 93 | 97 |
| MON | 83 | 87 |
| RVP, kPa | 50.3 (7.3 psi) | 53.8 (7.8 psi) |

The resulting RON, MON, and Reid vapor pressure numbers were measured for each of the blends with the following results.

| Gasoline | MDMB Vol % | RON Blend | MON Blend | RVP Blend, kPa | RVP Blend, psi |
|---|---|---|---|---|---|
| A | 13.8 | 95.6 | 85.2 | 45.5 | 6.6 |
| A | 18.7 | 96.3 | 85.8 | 43.4 | 6.3 |
| A | 24.3 | 97.3 | 87.0 | 37.9 | 5.5 |
| B | 14.2 | 98.8 | 88.2 | 42.7 | 6.2 |
| B | 19.2 | 99.4 | 88.8 | 46.2 | 6.7 |
| B | 24.9 | 99.9 | 89.6 | 40.7 | 5.9 |

These experimental values were used to calculate blending values of RON, MON, and RVP using the following equation (with RVP as an example):

$$RVP_{blend} = \frac{VOL_{gasoline}}{VOL_{gasoline} + VOL_{MDMB}} * RVP_{gasoline} + \frac{VOL_{MDMB}}{VOL_{gasoline} + VOL_{MDMB}} * RVPBV_{MDMB}$$

The calculated blending values for RON, MON, and RVP are listed in the table below.

Even though this equation is not 100% accurate for calculating octane numbers, as the RON and MON do not blend linearly, it can be used to predict. octane within ±1 number for the narrow range of blends investigated.

This example illustrates that the blending values for MDMB for the RON and MON are somewhat higher with an average of 110 and 97 respectively, and the RVP is about the same, as compared to the values for the RON, MON, and RVP of the MDMB component, which are 108, 97, and 7.3 kPa (1.06 psi) respectively. Also shown for reference are typical blending values for 15% MTBE, 10% ethanol and 12% TAME.

| COMPONENT | RON BV | MON BV | RVP BV |
|---|---|---|---|
| MDMB with Gasoline A | 112 | 98 | 1 |
| MDMB with Gasoline B | 109 | 96 | 1 |
| MTBE | 117 | 98 | 8.4 |
| ETHANOL | 115 | 96 | 22 |
| TAME | 106 | 94 | 4 |

One can see that the blending RON and MON values of MDMB are comparable to those of MTBE, ethanol, and TAME, which makes MDMB attractive as an octane booster for motor gasoline. MDMB's low blending RVP value makes it especially attractive as an octane booster in comparison to MTBE, ethanol, and TAME, as it does not carry a high RVP debit as is typically associated with the other octane boosters.

I claim:

1. A blend comprising:

(a) motor gasoline or motor gasoline feedstock; and (b) a composition comprising 2-methoxy-2,3-dimethyl butane (MDMB) which is present in a tertiary hexyl methyl ether composition in an amount sufficient to boost the octane numbers of component (a) by at least 1 unit, wherein said composition (b) has a Research Octane Number (RON) greater than 95 and a Motor Octane Number (MON) greater than 85.

2. The blend according to claim 1, wherein said composition (b) has a RON greater than 100 and a MON greater than 90.

3. The blend according to claim 2, wherein the composition (b) has a blending RON greater than 100 and a blending MON greater than 90.

4. The blend according to claim 2, wherein the composition (b) has a RON greater than 105 and a MON greater than 95.

5. The blend according to claim 1, wherein the tertiary hexyl methyl ether component of composition (b) comprises greater than 10% by weight of MDMB.

6. The blend according to claim 5, wherein the tertiary hexyl methyl ether component of composition (b) comprises from 20 to 100% by weight of MDMB.

7. The blend according to claim 6, wherein the tertiary hexyl methyl ether component of composition (b) comprises greater than 80% by weight of MDMB.

8. The blend according to claim 5, wherein the tertiary hexyl methyl ether component has a RON greater than 100 and a MON greater than 90.

9. The blend according to claim 5, wherein the tertiary hexyl methyl ether component has a RON greater than 100 or a MON greater than 90.

10. The blend according to claim 1, wherein the MDMB component has a RON greater than 105 and a MON greater than 95.

11. A blend according to claim 1, wherein the MDMB component has a blending RON greater than 105 and a blending MON greater than 95.

12. A blend according to claim 1, wherein the blend has a RON greater than 90 and a MON greater than 80.

13. A blend according to claim 12, wherein the blend has a RON greater than 93 and a MON greater than 83.

14. A blend comprising:

(a) motor gasoline or motor gasoline feedstock; and (b) an octane boosting amount of 2-methoxy-2,3-dimethyl butane (MDMB) which is present in a tertiary hexyl methyl ether composition in an amount sufficient to boost the octane numbers of component (a) by at least 1 unit, wherein said composition (b) has a Research Octane Number (RON) and a Motor Octane Number (MON) greater than those of component (a).

15. The blend according to claim 14, wherein said blend contains a sufficient amount of composition (b) to boost the octane number of component (a) by at least 2 units.

16. The blend according to claim 15, wherein said blend contains a sufficient amount of composition (b) to boost the octane number of component (a) by at least 3 units.

17. The blend according to claim 14, which comprises greater than 1% by volume of MDMB.

18. The blend according to claim 17, which comprises greater than 5% by volume of MDMB.

19. A blend comprising:

(a) motor gasoline or motor gasoline feedstock; and (b) an octane boosting amount of 2-methoxy-2,3-dimethyl butane (MDMB) which is present in a tertiary hexyl methyl ether composition in an amount sufficient to boost the octane numbers of component (a) by at least 1 unit, wherein said composition (b) has a Research Octane Number (RON) and a Motor Octane Number (MON) greater than those of component (a); and wherein said composition (b) is made by a process comprising:

(i) dimerizing propylene to form dimethylbutenes; and (ii) etherifying the dimethylbutenes with methanol to form said composition.

20. The blend according to claim 19, wherein step (ii) comprises partial etherification and is followed by (iii) hydrogenation of unetherified dimethylbutenes to form a tertiary hexyl methyl ether composition comprising MDMB and dimethyl butanes.

21. The blend according to claim 19, wherein composition (b) also contains dimethylbutenes, less than 1% methanol, and less than 5% olefins.

22. The blend according to claim 19, wherein said tertiary hexyl methyl ether composition contains greater than 50% by weight of MDMB.

23. The blend according to claim 19, wherein said tertiary hexyl methyl ether composition contains greater than 60% by weight of MDMB.

24. The blend according to claim 19, wherein said tertiary hexyl methyl ether composition contains greater than 80% by weight of MDMB.

25. A blend comprising:

(a) motor gasoline or motor gasoline feedstock; and (b) an octane boosting amount of 2-methoxy-2,3-dimethyl butane (MDMB) which is present in a tertiary hexyl methyl ether composition in an amount sufficient to boost the octane numbers of component (a) by at least 1 unit while at the same time increasing the Reid vapor pressure of component (a) by less than 2 psi, wherein said composition (b) has a Research Octane Number (RON) and a Motor Octane Number (MON) greater than those of component (a).

26. The blend according to claim 25, wherein the Reid vapor pressure of component (a) is increased by less than 1 psi.

27. The blend according to claim 26, wherein the Reid vapor pressure of component (a) is increased by less than 0.5 psi.

28. The blend according to claim 14, wherein said tertiary hexyl methyl ether composition contains greater than 50% by weight of MDMB.

29. The blend according to claim 28, wherein said tertiary hexyl methyl ether composition contains greater than 60% by weight of MDMB.

30. The blend according to claim 29, wherein said tertiary hexyl methyl ether composition contains greater than 80% by weight of MDMB.

31. The blend according to claim 25, wherein said tertiary hexyl methyl ether composition contains greater than 50% by weight of MDMB.

32. The blend according to claim 31, wherein said tertiary hexyl methyl ether composition contains greater than 60% by weight of MDMB.

33. The blend according to claim 32, wherein said tertiary hexyl methyl ether composition contains greater than 80% by weight of MDMB.

* * * * *